US006354180B1

(12) United States Patent
Hill

(10) Patent No.: US 6,354,180 B1
(45) Date of Patent: Mar. 12, 2002

(54) SYSTEM FOR CUTTING SHEET MATERIAL

(75) Inventor: Donald Hill, Glen Ellyn, IL (US)

(73) Assignee: Hill Engineering, Inc., Villa Park, IL (US)

( * ) Notice: Subject to any disclaimer, the term of this patent is extended or adjusted under 35 U.S.C. 154(b) by 0 days.

(21) Appl. No.: 09/205,925

(22) Filed: Dec. 4, 1998

(51) Int. Cl.[7] ..... B26D 1/12

(52) U.S. Cl. ..... 83/669; 83/670; 83/668; 83/662

(58) Field of Search ..... 83/669, 670, 686, 83/682, 115–118, 128, 76.7, 76.8

(56) References Cited

U.S. PATENT DOCUMENTS

| | | | | | |
|---|---|---|---|---|---|
| 2,450,312 | A | * | 9/1948 | Tollison | 83/117 |
| 2,518,960 | A | * | 8/1950 | Tollison et al. | 83/117 |
| 4,016,786 | A | * | 4/1977 | Korner | 83/670 |
| 4,257,291 | A | * | 3/1981 | Buchmann | 83/76.1 |
| 4,273,015 | A | * | 6/1981 | Johnson | 83/670 |
| 4,499,802 | A | * | 2/1985 | Simpson | 83/117 |
| 4,594,926 | A | * | 6/1986 | Propheter | 83/670 |
| 4,732,028 | A | | 3/1988 | Bodnar | |
| 4,736,661 | A | * | 4/1988 | Shirai | 83/76.1 |
| 4,784,031 | A | * | 11/1988 | Dixon | 83/117 |
| 4,793,113 | A | | 12/1988 | Bodnar | |
| 4,909,007 | A | | 3/1990 | Bodnar | |
| RE33,613 | E | | 6/1991 | Bodnar | |
| 5,040,397 | A | | 8/1991 | Bodnar | |
| 5,207,045 | A | | 5/1993 | Bodnar | |
| 5,363,728 | A | * | 11/1994 | Elsner et al. | 83/118 |
| 5,429,573 | A | * | 7/1995 | Jahnke et al. | 83/670 |
| 5,527,625 | A | | 6/1996 | Bodnar | |
| 5,561,998 | A | | 10/1996 | Bodnar | |
| 5,566,599 | A | * | 10/1996 | Ebihara | 83/76.1 |
| 5,592,848 | A | | 1/1997 | Bodnar | |
| 5,669,197 | A | | 9/1997 | Bodnar | |
| 5,887,502 | A | * | 3/1999 | Yamaguchi et al. | 83/670 |

* cited by examiner

*Primary Examiner*—M. Rachuba
(74) *Attorney, Agent, or Firm*—Wood, Phillips, VanSanten, Clark & Mortimer

(57) ABSTRACT

A system for cutting sheet material. The system has a first roller with at least one cutting element thereon with the first roller rotatable around a first axis and the second roller having at least one receptacle thereon and rotatable around a second axis. The first and second rollers are relatively positioned so that as the first and second rollers rotate around the first and second axes, the one cutting element aligns with and projects into the one receptacle to thereby cause cutting out of a discrete portion of a sheet material between the first and second rollers. A servo drive is provided for at least one of a) rotating the first roller around the first axis and b) rotating the second roller around the second axis.

19 Claims, 2 Drawing Sheets

SYSTEM FOR CUTTING SHEET MATERIAL

BACKGROUND OF THE INVENTION

1. Field of the Invention

This invention relates to systems for cutting sheet material and, more particularly, to a system employing two cooperating rollers to effect cutting of the sheet material.

2. Background Art

It is common in building construction to use studs made from sheet metal material. It is known to form cutouts in the sheet material to accommodate wiring, pipes, etc. These cutouts are commonly formed using hydraulic presses, air presses, etc. which form the cutout in a punching operation. Lines with these presses are known to run at speeds of 100 to 450 feet per minute, and at higher speeds with cutouts formed at longer intervals, i.e. on the order of 4 foot centers. Given the high demand for this type of stud in both the residential and commercial environments, increasing speed is an ever present goal for those designing sheet cutting systems.

It is known to use a roller pair with a cooperating punch and die arrangement to form a cutout in sheet material. In one form, a die opening is defined through one of the rollers to divert the cutouts to a space within the roller from where the cutout is removed before the next full revolution. The roller must thus be large enough to provide the cutout storage space and the path thereto from the point of cutting.

SUMMARY OF THE INVENTION

In one form, the invention is directed to a system for cutting sheet material. The system has a first roller with at least one cutting element thereon with the first roller rotatable around a first axis and the second roller having at least one receptacle thereon and rotatable around a second axis. The first and second rollers are relatively positioned so that as the first and second rollers rotate around the first and second axes, the one cutting element aligns with and projects into the one receptacle to thereby cause cutting out of a discrete portion of a sheet material between the first and second rollers. A servo drive is provided for at least one of a) rotating the first roller around the first axis and b) rotating the second roller around the second axis.

The first and second rollers cooperatively form a cutout from a sheet material. In one form, a biased pad on the second roller urges the cutout formed by the first and second rollers away from the second roller.

The bias pad may reside at least partially within the receptacle on the second roller.

The bias pad may be urged by at least one biasing element radially outwardly relative to the second axis. A plurality of coil springs may be used to produce the bias.

In one form, the cutting element has a cutting edge with a straight portion that is substantially coincident with a line extending radially from the first axis.

The receptacle is bounded by an edge. In one form, the edge has a straight portion that is substantially coincident with a line extending radially from the second axis.

A roll former/take up roll may be provided for advancing sheet material in a conveying direction between the first and second rollers independently of the first and second rollers.

In one form, a control is provided which senses movement of sheet material advancing in the conveying direction and coordinates rotation of the first and second rollers with movement of the sheet material in a predetermined manner.

The invention also contemplates a method of cutting sheet material, including the steps of: providing a first roller having at least one cutting element thereon and rotatable around a first axis; providing a second roller having at least one receptacle thereon and rotatable around a second axis; placing a sheet material between the first and second rollers; relatively rotating the first and second rollers to cause the one cutting element to project into the one receptacle and thereby form a cutout from the sheet material; and directing the cutout away from the second roller as an incident of the second roller rotating around the second axis.

The method may further include the step of providing a pad. The step of directing the cutout away from the second roller may include the step of repositioning the pad relative to the second roller to thereby move the cutout radially outwardly from the second roller relative to the second axis.

The invention may further include the step of providing a servo drive, with the step of relatively rotating the first and second rollers involving the step of at least one of a) rotating the first roller around the first axis and b) rotating the second roller around the second axis through the servo drive.

The method may include the step of advancing the sheet material in a conveying direction between the first and second rollers independently of the first and second rollers.

The method may further include the step of sensing movement of the sheet material advancing in the conveying direction and coordinating rotation of the first and second rollers with movement of the sheet material in a predetermined manner.

The step of coordinating rotation of the first and second rollers with movement of the sheet material may involve the step of one of a) stopping and b) varying the speed of rotation of the first and second rollers while allowing the sheet material to advance in the conveying direction at a predetermined speed for a predetermined time interval, and after the predetermined time interval one of c) rotating the first and second rollers and d) again varying the speed of rotation of the first and second rollers as sheet material is advanced in the conveying direction at the predetermined speed.

The invention is further directed to a system for cutting sheet material, which system has a first roller and a second roller, as previously described. The first and second rollers are relatively positioned so that as the first and second rollers rotate around the first and second axes, the one cutting element projects into the one receptacle to thereby form a cutout from a sheet material between the first and second rollers. The pad resides at least partially within the receptacle and urges a cutout formed by the first and second rollers away from the second roller.

The pad may be biased radially outwardly relative to the second axis as by a plurality of coil springs.

In one form, the pad resides at least partially within the receptacle and causes the cutout formed in sheet material by the first and second rollers to be urged out of the receptacle and separated from the second roller as the second roller rotates.

The invention is also directed to a system for cutting sheet material having a first roller and second roller, as previously described. The first and second rollers are relatively positioned so that as the first and second rollers rotate around the first and second axes, the one cutting element aligns with and projects into the one receptacle to thereby cut out a discrete portion of a sheet material between the first and second rollers. The cutting element has a cutting edge and the receptacle is bounded by an edge. At least one of a) a portion of the cutting edge is substantially coincident with a line extending radially from the first axis and b) a portion of the edge bounding the receptacle is substantially coincident with a line extending radially from the second axis.

DETAILED DESCRIPTION OF THE DRAWINGS

Figure 1:
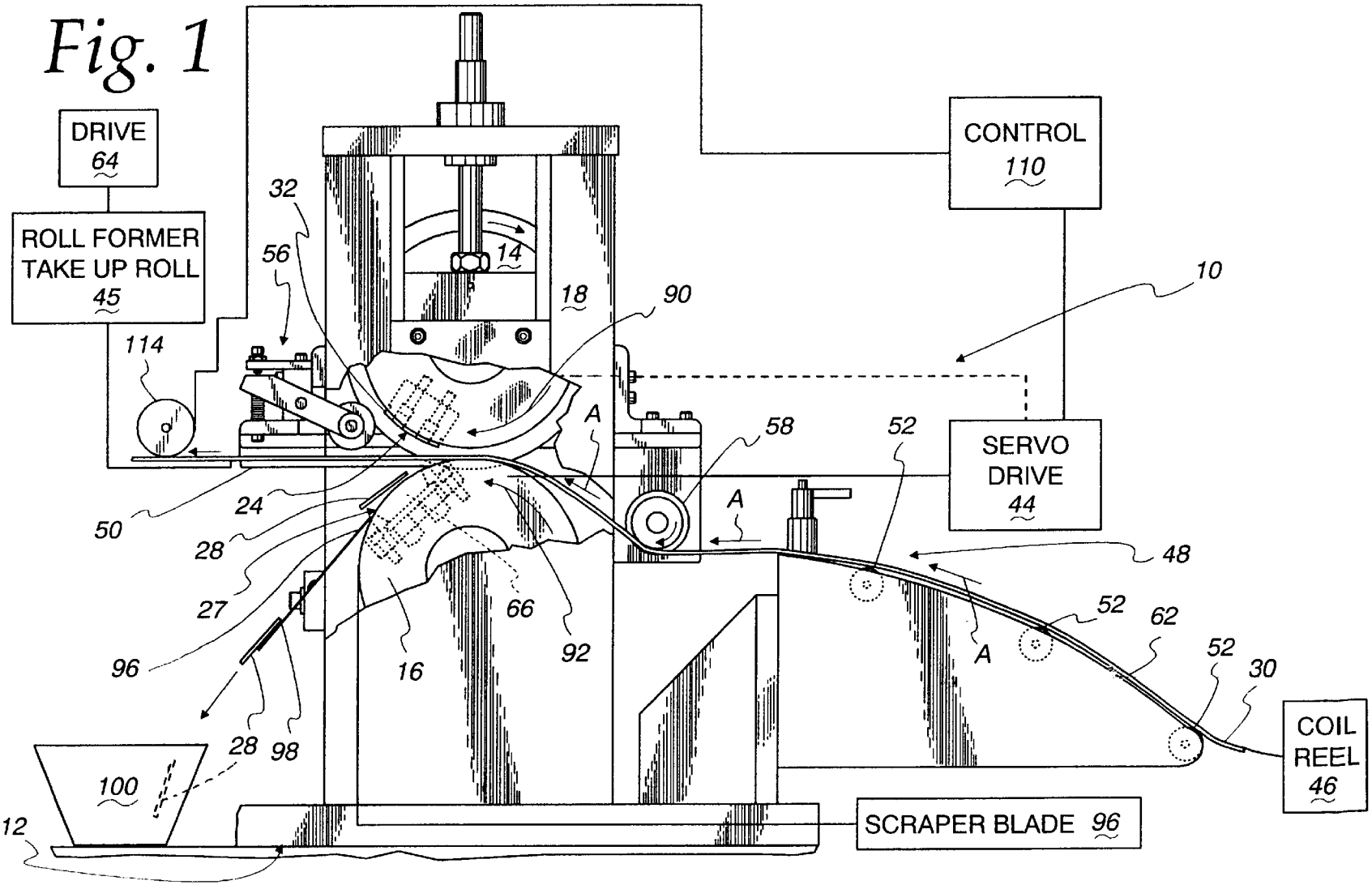
FIG. 1 is a partially schematic, side elevation view of a system for cutting sheet material, according to the present invention.
Figure 2:
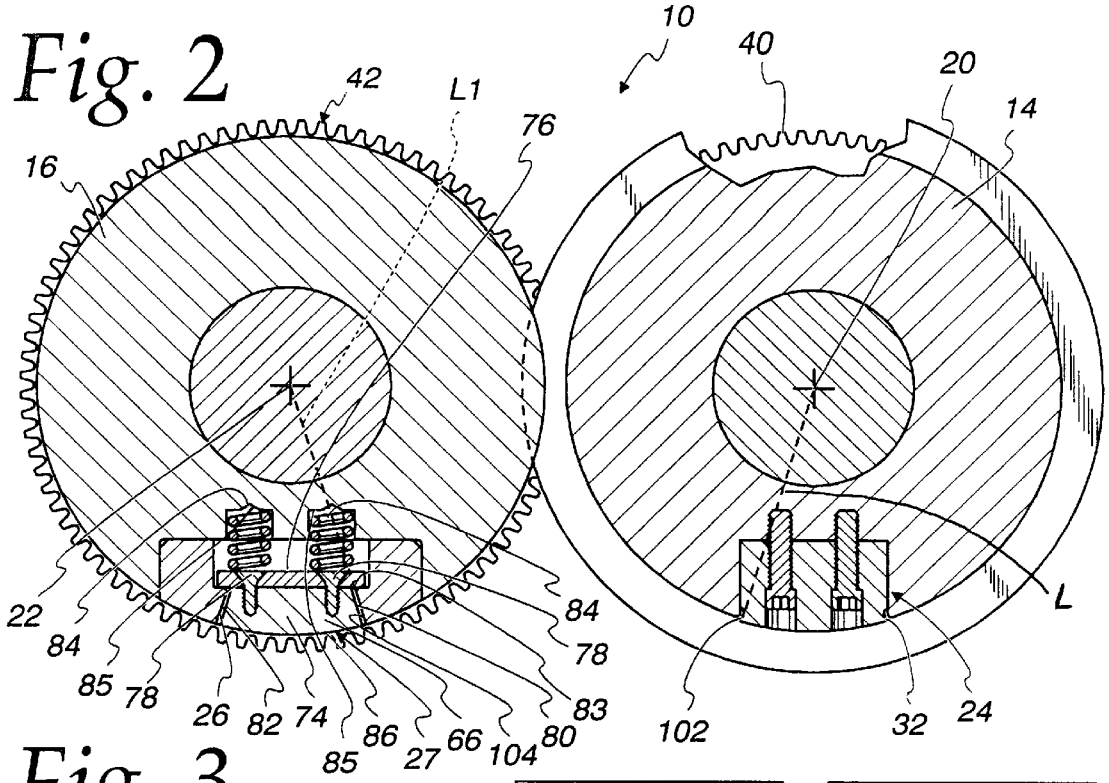
FIG. 2 is an enlarged, cross-sectional view of cooperating rollers on the system in FIG. 1 between which a sheet material moves to be cut, with the rollers including a cooperating punch and die.
Figure 3:
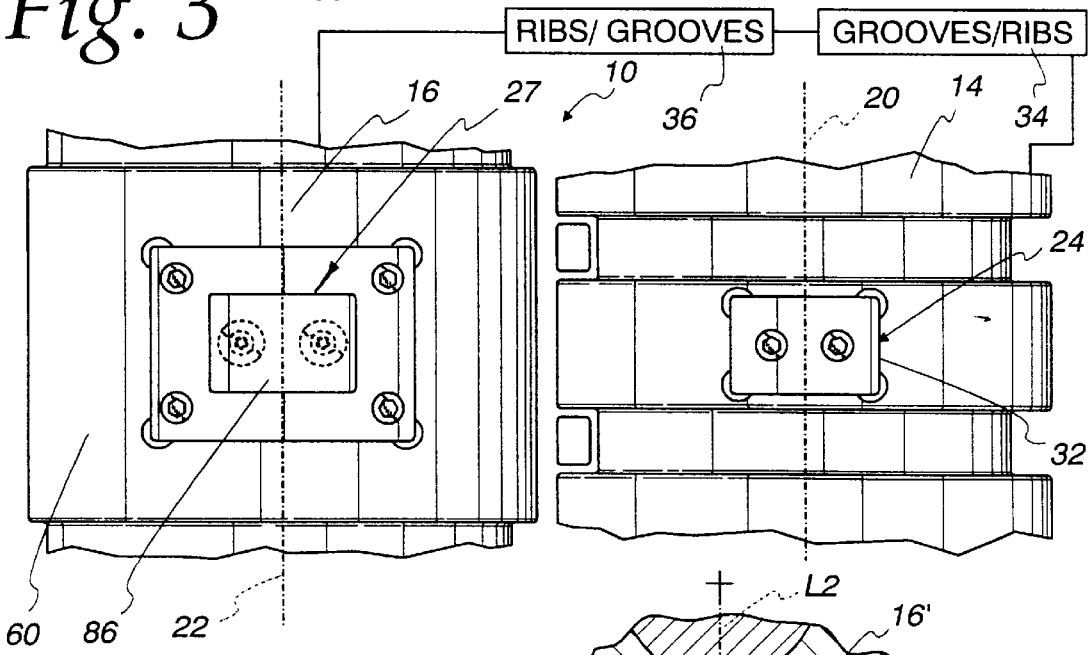
FIG. 3 is an enlarged, fragmentary, plan view of the rollers in FIG. 2 and showing the punch and die.

Referring initially to FIGS. 1–3, a system for cutting sheet material, according to the present invention, is shown at 10. The system 10 consists of a frame 12 which mounts first and second rollers 14, 16 in operative relationship. The first roller 14 spans between spaced frame parts 18 (one shown) and is rotatable guidingly around a first axis 20, with the second roller 16 mounted to the frame parts 18 in like manner for rotation around a second axis 22 that is parallel to the first axis 20.

The first roller 14 has a punch/cutting element 24 thereon which cooperates with a receptacle 26 formed by a die 27 on the second roller 16. The first and second rollers 14, 16 are relatively positioned through the frame 12 so that as the first and second rollers 14, 16 rotate around the first and second axes 20, 22, the cutting element 24 aligns with and projects into the receptacle 26 to thereby cause cutting out of a discrete portion, i.e. a cutout 28, of a sheet material 30 that is advanced between the first and second rollers 14, 16. In this case, one cutting element 24 is provided on the first roller and one die 27 is provided on the second roller 16 so that the cutting element 24 and receptacle 26 register one time and produce one cutout 28 for each rotation of the rollers 14, 16. The invention contemplates that additional cutting elements 24 and dies 27 could be provided on the rollers 14, 16.

The size and shape of the cutouts 28 are dictated by, in this case, the circumferentially exposed cutting edge 32 of the cutting element 24. The rectangular shape shown is but exemplary of the many sizes and shapes contemplated by the present invention. In this case, the rectangular shape shown is commonly used to form openings in studs made from the sheet material 30. Studs are similarly exemplary of the many products that can be made from sheet material using the present invention.

The rollers 14, 16 are conventionally guided in movement and maintained in a desired axial relationship by laterally spaced, circumferentially extending, cooperating ribs/grooves 34 on the first roller 14 and grooves/ribs 36 on the second roller 16 as is conventional and shown schematically herein (See FIG. 3). The roller 14 has an annular arrangement of gear teeth 40 in mesh with an annular arrangement of gear teeth 42 on the roller 16. The gear teeth 40, 42 are in mesh to maintain the desired circumferential registration between the rollers 14, 16. Conventional structure may be incorporated to make fine circumferential adjustments between the rollers 14, 16. With this arrangement, it is necessary to drive only one of the rollers 14, 16. In this case, the second roller 16 is rotated, as by a belt, through a servo drive 44. The servo drive 44 can drive the first roller 14 in rotation, as indicated by the dotted lines connecting therebetween.

In the system 10 disclosed, the sheet material 30 is in the form of a continuous web which is drawn in a conveying direction, as indicated by the arrows A, by a roll former/take up roll 45. More specifically, the roll former/take up roll 45 draws the sheet material 30 from a coil reel 46 containing a bulk supply of the sheet material 30 which is directed over a guide section 48 that is part of the frame 12, to between the rollers 14, 16 and away therefrom to overlie a support table 50. The guide section 48 has a plurality of rollers 52 which are spaced from each other in the conveying direction and are progressively vertically higher between the coil reel 46 and the rollers 14, 16. The sheet material 30 is draped over the rollers 52 and is guided thereover. A hold down/stripping mechanism 56 maintains the sheet material 30 facially against the support table 50 as it exits from between the rollers 14, 16. A variable tension is settable through a hold-down roller 58 which bears against an unsupported portion of the sheet material 30 between the guide section 48 and the rollers 14, 16.

With this arrangement, the sheet material 30 is advanced at a speed as dictated by the roll former/take up roll 45 and is placed under a predetermined tension and urged downwardly against the roller 16. A slight gap, on the order of 0.06 inch, is maintained between the circumferential surface 60 of the roller 16, from which the cutting element 24 projects, and the upper surface 62 of the sheet material 30.

With this arrangement, the speed of advancement of the web 30 is set independently of the movement of the rollers 14, 16. Thus, by controlling a drive 64 for the roll former/take up roll 45, the speed of advancement of the sheet material 30 can be selected. Similarly, through the servo drive 44, the rollers 14, 16 can be stopped, rotated, and the speed thereof selectively varied, independently of the advancing sheet material 30.

As the rollers 14, 16 rotate around their respective axes 20, 22, the cutting edge 32 on the cutting element 24 advances into the receptacle 26 to thereby sever the sheet material 30 and form the cutout 28 therein. In this embodiment, the cutouts 28 are ejected from the receptacle 26 by a biased pad 66 that is part of the die 27 and which floats between cutting and eject positions. The pad 66 has a two-part construction, in this case having a first part 74 which conforms to and is slightly smaller in dimension than the complementary receptacle 26, and a second part 76 which is joined by screws 78 to the first part 74. With this arrangement, floating movement of the pad 66 is limited radially inwardly by the abutment of a circumferential surface 80 on the pad 66 with an edge 82 bounding the receptacle 26. Radial outward movement of the pad 66 is confined by the abutment of the second part 76 to a radially inwardly facing shoulder 83.

At least one biasing element, and in this case two coil springs 84, act between surfaces 85 defined by blind bores in the roller 16 and the second pad part 76 to normally urge the pad 66 into abutting relationship with the shoulder 83, representing the eject position. In the eject position, a radially outwardly facing surface 86 on the second part 76 is flush with, and conforms to the curvature of, the roller surface 60.

In operation, for each revolution, the cutting edge 32 aligns over the receptacle 26 with the cutting edge 32 on the first roller 14 in a six o'clock position and the receptacle 26 on the second roller 16 in a twelve o'clock position in FIG. 1. As the cutting clement 24 penetrates the receptacle 26, the pad 66 moves radially inwardly by compressing the springs 84 to the cutting position therefor. After the cutout 28 is formed, continued rotation of the roller 14 in the direction of the arrow 90 and the roller 16 in the direction of the arrow 92 causes the cutout 28 and pad 66 to become exposed. The cutout 28 is ejected as the springs 84 urge the pad 66 radially outwardly to the eject position.

Whereas it is common in the prior art to direct cutouts through a roller and accumulate the cutouts for subsequent disposal by ejecting the cutout 28 with each rotation of the rollers 14, 16, no accommodation need be made for guiding the cutouts 28 or for an accumulation or guiding of cutouts 28 in the roller 16. As a result, the roller 16 can be made of such a size and weight to be operated by a servo drive motor 44.

An optional scraper blade 96 can be incorporated to skim the roller surface 60 in the event that the cutout 28 does not properly clear from the receptacle 26 as an incident of the rotation of the roller 16. In either event, whether the cutouts 28 are properly ejected or is removed by the scraper blade 96, the cutouts 28 arc carried by their momentum and weight in a downward direction and intercepted by a ramp 98 which guides the cutouts 28 for accumulation in a receptacle 100.

In the embodiment shown in FIGS. 1–3, the cutting element edge 32 has a straight/flat portion 102 that is substantially coincident with a line L extending radially from the first axis 20. Similarly, the edge 82 bounding the receptacle 26 has a straight/flat portion 104 that is substantially coincident with a line L1 extending radially from the second axis 22. This construction has been found highly effective for producing cutouts 28 that are several inches in length.

Figure 4:
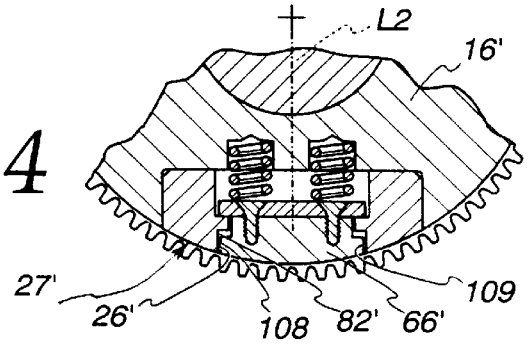
FIG. 4 is an enlarged, fragmentary, cross-sectional view of one of the rollers in FIGS. 2 and 3 with a modified form of die, according to the present invention.

As shown in FIG. 4, an alternative form of die element 27', corresponding to that 27 has a biased pad 66' movable within a receptacle 26' bounded by an edge 82' with facing, flat, edge portions 108, 109 which are non-coincident with any radial line from the rotational axis 22' of the roller 16'. In this case, spaced portions 108, 109 of the edge 82' are substantially parallel to each other and the radial line L2 which bisects the pad 66'.

Referring back to FIGS. 1–3, a control 110 is provided to coordinate rotation of the rollers 14, 16 with advancement of the sheet material 30. The control 110 can be pre-programmed to coordinate operation of the servo drive 44 in conjunction with a rotary encoder 114 to produce the cutouts 28 at desired locations along the length of the sheet material 30. For example, the control 110 can be programmed so that a certain number of the cutouts 28 are to be formed at two foot centers while others are to be formed at four foot centers. The control 110 can cause the servo drive 44 to stop and restart at spacings tracked by the rotary encoder 114 and determined by the controller 110 to produce the desired spacing in between the cutouts 28. Alternatively, the speed of the servo drive 44 could be varied to produce the same effect.

The foregoing disclosure of specific embodiments is intended to be illustrative of the broad concepts comprehended by the invention.

I claim:

1. A system for cutting sheet material, said system comprising:

a first roller having at least one cutting element thereon and rotatable around a first axis; and a second roller having at least one receptacle thereon and rotatable around a second axis, the first and second rollers being relatively positioned so that as the first and second rollers rotate around the first and second axes, the one cutting element aligns with and projects into the one receptacle to thereby cause cutting out of a discrete portion of a sheet material between the first and second rollers, wherein the cutting element has a cutting edge with a straight portion that is substantially coincident with a line extending radially from the first axis.

2. The system for cutting sheet material according to claim 1 wherein the first and second rollers cooperatively form a cutout from a sheet material and there is a biased pad on the second roller that urges a cutout formed by the first and second rollers away from the second roller.

3. The system for cutting sheet material according to claim 2 wherein the biased pad resides at least partially within the receptacle on the second roller.

4. The system for cutting sheet material according to claim 3 wherein the biased pad is urged by at least one biasing element radially outwardly relative to the second axis.

5. The system for cutting sheet material according to claim 4 wherein the biased pad is urged radially outwardly relative to the second axis by a plurality of cold springs.

6. The system for cutting sheet material according to claim 1 wherein the receptacle is bounded by an edge with a straight portion that is substantially coincident with a line extending radially from the second axis.

7. The system for cutting sheet material according to claim 1 including a roll former/take up roll for advancing sheet material in a conveying direction between the first and second rollers independently of the first and second rollers.

8. The system for cutting sheet material according to claim 7 including a control which senses movement of sheet material advancing in the conveying direction and coordinates rotation of the first and second rollers and movement of sheet material in a predetermined manner.

9. The system for cutting sheet material according to claim 7 further comprising sheet material which is advanced by the roll former/take up roll.

10. A system for cutting sheet material, said system comprising:

a first roller having at least one cutting element with a cutting edge thereon and rotatable around a first axis;

a second roller having at least one receptacle thereon and rotatable around a second axis, the first and second rollers being relatively positioned so that as the first and second rollers rotate around the first and second axes, the one cutting element projects into the one receptacle to thereby form a discrete cutout that is separated from a sheet material between the first and second rollers and has a shape corresponding to the shape of the cutting edge; and a pad which resides at least partially within the receptacle that urges a discrete cutout formed by the first and second rollers away from the second roller.

11. The system for cutting sheet material according to claim 10 wherein the pad is biased radially outwardly relative to the second axis.

12. The system for cutting sheet material according to claim 11 wherein the pad is biased by a plurality of coil springs.

13. The system for cutting sheet material according to claim 11 wherein the pad resides at least partially within the receptacle and causes a cutout formed in a sheet material by the first and second rollers to be urged out of the receptacle and separated from the second roller as the second roller rotates.

14. The system for cutting sheet material according to claim 10 further comprising a sheet material which is movable between the first and second rollers.

15. A system for cutting sheet material, said system comprising:

a first roller having at least one cutting element thereon and rotatable around a first axis; and a second roller having at least one receptacle thereon and rotatable around a second axis, the first and second rollers being relatively positioned so that as the first and second rollers rotate around the first and second axes, the one cutting element aligns with and projects into the one receptacle to thereby cause cutting out of a discrete portion of a sheet material between the first and second roller, wherein the cutting element has a cutting edge and the receptacle is bounded by an edge, wherein at least one of a) a portion of the cutting edge is substantially coincident with a line extending radially from the first axis and b) a portion of the edge bounding the receptacle is substantially coincident with a line extending radially from the second axis.

16. The system for cutting sheet material according to claim 15 further comprising a pad residing at least partially within the receptacle for urging a cutout formed in sheet material by the rollers to be urged out or the receptacle.

17. The system for cutting sheet material according to claim 15 further comprising a sheet material which is movable between the first and second rollers.

18. A system for cutting sheet material, said system comprising:

a first roller having at least one cutting element thereon and rotatable around a first axis; and a second roller having at least one receptacle thereon and rotatable around a second axis, the first and second rollers being relatively positioned so that as the first and second rollers rotate around the first and second axes, the one cutting element aligns with and projects into the one receptacle to thereby cause cutting out of a discrete portion of a sheet material between the first and second rollers, wherein the receptacle is bounded by an edge with a straight portion that is substantially coincident with a line extending radially from the second axis.

19. The system for cutting sheet material according to claim 1 further comprising a servo drive for at least one of a) rotating the first roller around the first axis, and b) rotating the second roller around the second axis.

* * * * *